US007826762B2

(12) United States Patent
Tomiyasu et al.

(10) Patent No.: US 7,826,762 B2
(45) Date of Patent: Nov. 2, 2010

(54) IMAGE FORMING APPARATUS WITH TONER FUSION PREVENTING FEATURE FOR PREVENTING TONER FUSION BETWEEN RECORDING SHEETS

(75) Inventors: Hiroaki Tomiyasu, Toride (JP); Ryo Hanashi, Moriya (JP); Masahiro Komoto, Toride (JP)

(73) Assignee: Canon Kabushiki Kaisha (JP)

( * ) Notice: Subject to any disclaimer, the term of this patent is extended or adjusted under 35 U.S.C. 154(b) by 149 days.

(21) Appl. No.: 12/182,058

(22) Filed: Jul. 29, 2008

(65) Prior Publication Data

US 2009/0035006 A1 Feb. 5, 2009

(30) Foreign Application Priority Data

Jul. 30, 2007 (JP) ..... 2007-197495

(51) Int. Cl.
*G03G 15/00* (2006.01)

(52) U.S. Cl. ..... 399/82; 399/16; 399/38; 399/407

(58) Field of Classification Search ..... 399/16, 399/38, 82, 407, 408, 410, 68, 27
See application file for complete search history.

(56) References Cited

U.S. PATENT DOCUMENTS 5,978,561 A * 11/1999 Kimura et al. ..... 358/1.16
6,829,448 B2 * 12/2004 Ozawa et al. ..... 399/55
2004/0002015 A1 * 1/2004 Ozawa et al. ..... 430/122
2009/0028587 A1 * 1/2009 Hanashi et al. ..... 399/27

FOREIGN PATENT DOCUMENTS

JP 2003-248349 A 9/2003
JP 2006-150798 A * 6/2006
JP 2006-243498 A 9/2006
JP 2006-349755 A 12/2006

OTHER PUBLICATIONS

Specification, claims, abstract and drawings of related co-pending U.S. Appl. No. 12/182,052, filed Jul. 30, 2008; 48 pages.

* cited by examiner

*Primary Examiner*—Sophia S Chen
(74) *Attorney, Agent, or Firm*—Rossi, Kimms & McDowell LLP

(57) ABSTRACT

An image forming apparatus capable of preventing toner fusion between recording sheets to thereby offer high usability, with a construction that does not cause increase in cost and size of the apparatus and an undue reduction in productivity. In the image forming apparatus, a toner use amount in a partial region of an toner image transferred from an intermediate transfer belt to a recording sheet is detected. When it is determined that the toner use amount detected for the partial region is equal to or greater than a predetermined amount, a recording sheet conveyance interval is widened.

3 Claims, 11 Drawing Sheets

IMAGE FORMING APPARATUS WITH TONER FUSION PREVENTING FEATURE FOR PREVENTING TONER FUSION BETWEEN RECORDING SHEETS

BACKGROUND OF THE INVENTION

1. Field of the Invention

The present invention relates to an image forming apparatus, and more particularly, to an image forming apparatus for preventing stacking failure of discharged recording sheets and alignment failure at the time of stapling of recording sheets due to toner fusion and for suppressing a reduction in productivity.

2. Description of the Related Art

In a conventional image forming apparatus in which a toner image is thermally fixed to a recording sheet, toner fusion sometimes takes place between stacked recording sheets, which are raised in temperature at thermal fixing, when post-processing is carried out thereon. As a result of the toner fusion, toner images are peeled off from recording sheets and stacking failure of recording sheets is caused, which poses a problem.

To obviate this, it has been proposed to cool a transfer guide member by means of a cooling fan disposed near a sheet discharge port, thereby cooling recording sheets before being subjected to post-processing (see, for example, Japanese Laid-open Patent Publication No. 2006-349755).

Moreover, for a case where recording sheets such as OHP sheets between which toner fusion easily occurs are used, there has been proposed a cooling system in which the discharge of recording sheets onto a stacking tray is temporarily delayed, thereby cooling the recording sheets (see, for example, Japanese Laid-open Patent Publication No. 2003-248349). With this cooling system, however, when applied to an image forming apparatus having a fear that toner fusion occurs even between ordinary sheets, the sheet discharging time interval must be increased at the time of post-processing on the ordinary sheets, resulting in a high possibility that user's demand on improved productivity cannot be satisfied.

To solve this problem, it has been proposed to detect the toner density on each recording sheet and change the sheet discharge interval, if the detected density is greater than a critical density at or above which toner fusion takes place (see, for example, in Japanese Laid-open Patent Publication No. 2006-243498).

In a small machine demanded to be compact in size and low in cost, however, conventional cooling means such as a cooling fan for cooling recording sheets cannot positively be adopted. Especially in a small machine for office use, a thermal fixing mechanism is disposed adjacent to a sheet discharging part, and therefore, it is difficult to find an installation space for a cooling fan. Since a sheet discharging tray is small in size, a cooling fan is also difficult to be installed on the sheet discharge tray.

In controlling the interval of conveyance of discharged recording sheets in accordance with a possibility of occurrence of toner fusion estimated based on the determined toner density, toner fusion sometimes takes place only in a local part of the entire toner image. In such a case, if the toner fusion is determined based on the toner density on the entire toner image, the recording sheet conveyance interval can excessively be widened, resulting in a problem of reduction in productivity.

SUMMARY OF THE INVENTION

The present invention provides an image forming apparatus capable of preventing toner fusion between recording sheets to thereby offer high usability, with a construction which does not cause substantial increase in cost and size of the apparatus and an undue reduction in productivity.

According to the present invention, there is provided an image forming apparatus comprising a transfer unit adapted to transfer a toner image onto a recording sheet, a detection unit adapted to detect a toner use amount at transfer of a partial region of the toner image onto the recording sheet by the transfer unit, and a control unit adapted to control a recording sheet conveyance interval in accordance with the toner use amount detected by the detection unit for the partial region of the toner image.

According to the present invention, it is possible to prevent toner fusion between recording sheets to thereby offer high usability, with a construction that does not cause increase in cost and size of the apparatus and an undue reduction in productivity.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
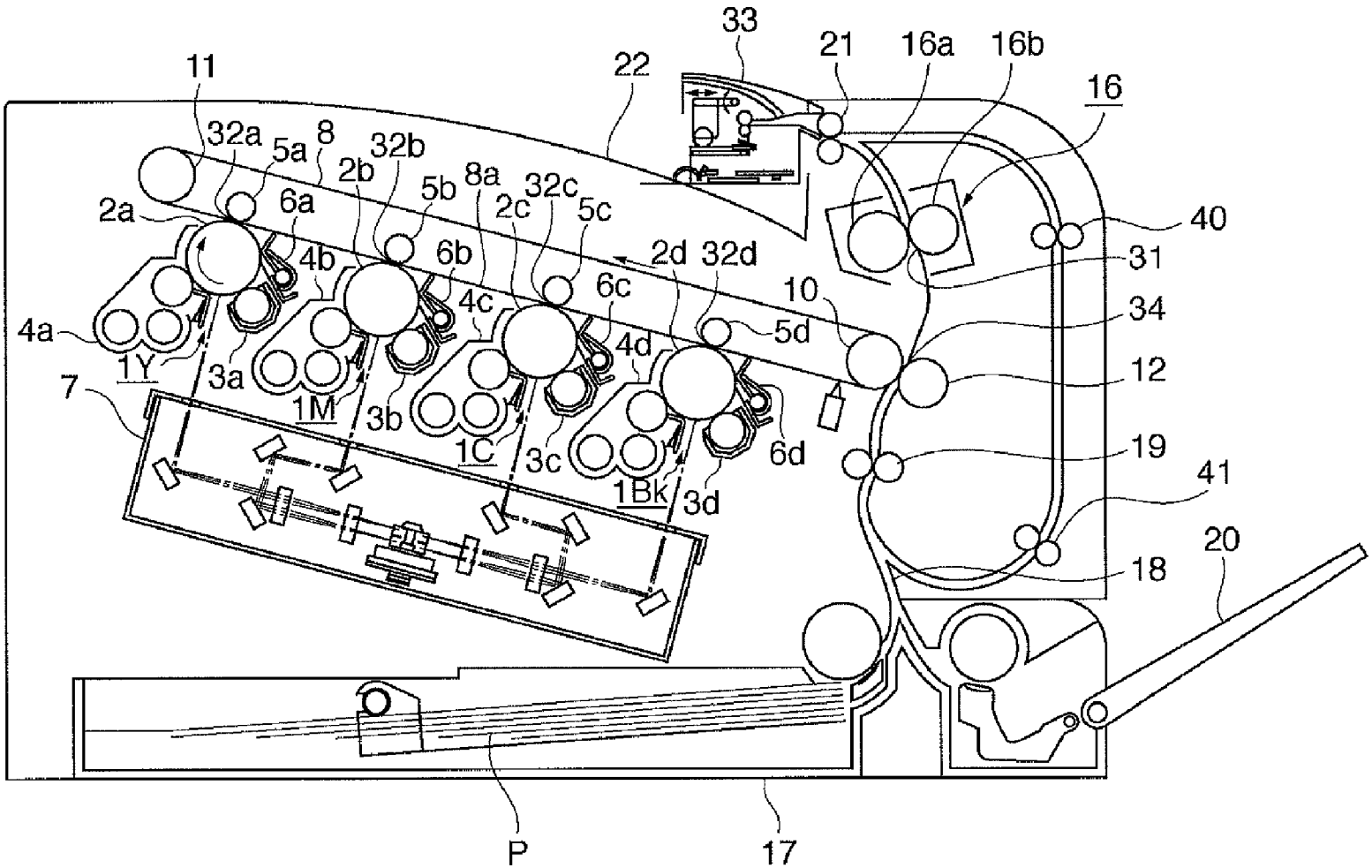
FIG. 1 is a view showing the construction of a full color printer as an image forming apparatus according to one embodiment of this invention.

FIG. 1 shows the construction of a full color printer as an image forming apparatus according to one embodiment of this invention.

The full color printer includes four image forming units. The four image forming units are image forming units 1Y, 1M, 1C, and 1Bk for forming an yellow colored image, a magenta colored image, a cyan colored image, and a black colored image, respectively. These image forming units 1Y, 1M, 1C, 1Bk are disposed on a line with a predetermined distance therebetween.

The toner image forming units 1Y, 1M, 1C, 1Bk respectively include drum-type electrophotographic photosensitive members (hereinafter referred to as the "photosensitive drums") 2*a* to 2*d* serving as image carriers.

Around the photosensitive drums 2*a*, 2*b*, 2*c*, 2*d*, there are disposed primary charging devices 3*a*, 3*b*, 3*c*, 3*d*, developing devices 4*a*, 4*b*, 4*c*, 4*d*, transfer rollers 5*a*, 5*b*, 5*c*, 5*d* as transfer units, and drum cleaners 6*a*, 6*b*, 6*c*, 6*d*.

A laser exposure unit 7 is disposed below the primary charging devices 3*a*-3*d* and the developing devices 4*a*-4*d*.

The developing devices 4*a*-4*d* respectively contain yellow toner, cyan toner, magenta toner, and black toner.

The photosensitive drums 2*a*-2*d* are each comprised of a negatively chargeable OPC photosensitive member having an aluminum drum member thereof formed with a photoconductive layer thereon, and are rotatably driven by a driving unit (not shown) at a predetermined process speed in a clockwise direction in FIG. 1.

The primary charging devices 3*a*-3*d* functioning as primary charging units uniformly charge surfaces of the photosensitive drums 2*a*-2*d* at a predetermined negative potential with charging bias applied from a charging bias power source (not shown).

The developing devices 4*a*-4*d* cause color toners to be adhered to electrostatic latent images formed on the photosensitive drums 2*a*-2*d*, to thereby develop (visualize) the electrostatic latent images into toner images.

The transfer rollers 5*a*-5*d* functioning as the primary transfer units are disposed for contact at primary transfer parts 32*a*-32*d* with the photosensitive drums 2*a*-2*d* via an intermediate transfer belt 8 functioning as a transfer unit.

The drum cleaners 6*a*-6*d* have cleaning blades for removing residual toner remaining on the photosensitive drums 2*a*-2*d* after the primary transfer.

The intermediate transfer belt 8 is disposed on the upper surface side of the photosensitive drums 2*a*-2*d* and stretched between a secondary transfer opposed roller 10 and a tension roller 11. The secondary transfer opposed roller 10 is disposed for contact at a secondary transfer part 34 with a secondary transfer roller 12 via the intermediate transfer belt 8. The intermediate transfer belt 8 is comprised of dielectric resin such as poly carbonate, poly ethylene terephthalate resin film, or poly vinylidene diffluoride resin film.

The intermediate transfer belt 8 is disposed to be inclined such that a primary transfer surface 8*a* thereof facing the photosensitive drums 2*a*-2*d* is at a lower height level on its secondary transfer roller 12 side than on another side thereof.

Specifically, the intermediate transfer belt 8 is movable relative to the photosensitive drums 2*a*-2*d* and inclined such that the primary transfer surface 8*a* is at a lower height level on the secondary transfer part 34 side than on the other side thereof.

More specifically, the angle of inclination is set at about 15 degrees. The intermediate transfer belt 8 is stretched between the secondary transfer opposed roller 10 disposed on the secondary transfer part 34 side for applying a driving force to the intermediate transfer belt 8 and the tension roller 11 for applying a tension force to the intermediate transfer belt 8, the tension roller 11 being disposed on the side opposite from the roller 10 with respect to the primary transfer parts 32*a*-32*d* disposed therebetween.

The secondary transfer opposed roller 10 is disposed for contact at the secondary transfer part 34 with the second transfer roller 12 via the intermediate transfer belt 8. On the outside of the endless intermediate transfer belt 8 and near the tension roller 11, there is disposed a belt cleaner (not shown) for removing and collecting residual toner remaining on the surface of the intermediate transfer belt 8.

On the side downstream of the secondary transfer part 34 in the direction in which a recording sheet P is conveyed, a fixing unit 16 including a fixing roller 16*a* and a pressurizing roller 16*b* is disposed in a longitudinal path construction.

The laser exposure unit 7 includes a laser emitting unit for emitting light in accordance with a time-series of electric digital image signals of given image information, and includes a polygon lens, a reflection mirror, and the like. The laser exposure unit 7 exposes the photosensitive drums 2*a*-2*d* to light, thereby forming electrostatic latent images in respective colors, corresponding to the image information, on the surfaces of the photosensitive drums 2*a*-2*d* which are charged by the primary charging devices 3*a*-3*d*.

Next, an image forming operation of the image forming apparatus (full color printer) is described.

When an image formation start signal is delivered, the photosensitive drums 2*a*-2*d* of the image forming units 1Y, 1M, 1C, 1Bk rotatably driven at a predetermined process speed are uniformly charged in negative polarity by the primary charging devices 3*a*-3*d*.

Next, the laser exposure unit 7 irradiates laser light from the laser emitting unit in accordance with a color-separated image signal which is externally input. The laser light is irradiated onto the photosensitive drums 2*a*-2*d* via the polygon lens, the reflection mirror, etc., whereby electrostatic latent images in respective colors are formed on the photosensitive drums 2*a*-2*d*.

Then, by means of the developing device 4*a* applied with a developing bias which is the same in polarity as the polarity of electrification (negative) of the photosensitive drum 2*a*, yellow toner is adhered to the electrostatic image formed on the photosensitive drum 2*a*, whereby the electrostatic latent image is visualized.

At the primary transfer part 32*a* between the photosensitive drum 2*a* and the transfer roller 5*a*, the yellow toner image is primary-transferred onto the intermediate transfer belt 8, which is being driven, by means of the transfer roller 5*a* applied with primary transfer bias (which is opposite (positive) in polarity to the toner).

The intermediate transfer belt 8 to which the yellow toner image has been transferred is moved toward the toner image forming unit 1M. Then, a magenta toner image formed on the photosensitive drum 2*b* in the toner image forming unit 1M is similarly transferred onto the intermediate transfer belt 8 at the primary transfer part 32*b* such as to be superimposed on the yellow toner image on the intermediate transfer belt 8.

At this time, residual toner remaining on the photosensitive drums 2*a*-2*d* is scraped off for recovery by means of cleaner blades or the like provided on the drum cleaners 6*a*-6*d*.

Similarly, cyan and black toner images formed on the photosensitive drums 2*c*, 2*d* of the image forming units 1C, 1Bk are sequentially superposed on the yellow and magenta toner images formed in layer on the intermediate transfer belt 8 at the primary transfer parts 32*c*, 32*d*. As a result, a full color toner image is formed on the intermediate transfer belt 8.

The recording sheet P is conveyed by registration rollers 19 to the secondary transfer part 34 between the secondary transfer opposed roller 10 and the secondary transfer roller 12 in timing in which the tip end of the full color toner image on the intermediate transfer belt 8 is moved to the secondary transfer part 34. The recording sheet P is fed via a conveyance path 18 from a sheet feed cassette 17 or a manual feed tray 20.

By means of the secondary transfer roller 12 applied with secondary transfer bias (which is opposite (positive) in polarity to the toner), the full color toner image is secondary-transferred onto the recording sheet P conveyed to the secondary transfer part 34.

A recording sheet P on which the full color toner image has been formed is conveyed to the fixing unit 16. The full color toner image is heated and pressurized at a fixing nip part 31 between the fixing roller 16*a* and the pressurizing roller 16*b*. As a result, the full color toner image is thermally fixed on a surface of the recording sheet P. Subsequently, the recording sheet P is caused by a sheet discharge roller 21 to enter a post-processing apparatus, described later, and discharged onto a sheet discharge tray 22 disposed on an upper surface of the main body of the apparatus. Whereupon, a series of image forming operations is completed.

Toner remaining on the intermediate transfer belt 8 after the secondary transfer is removed for recovery by the belt cleaner. In the above, the image forming operation at the time of single-sided image formation has been described.

Figure 2:
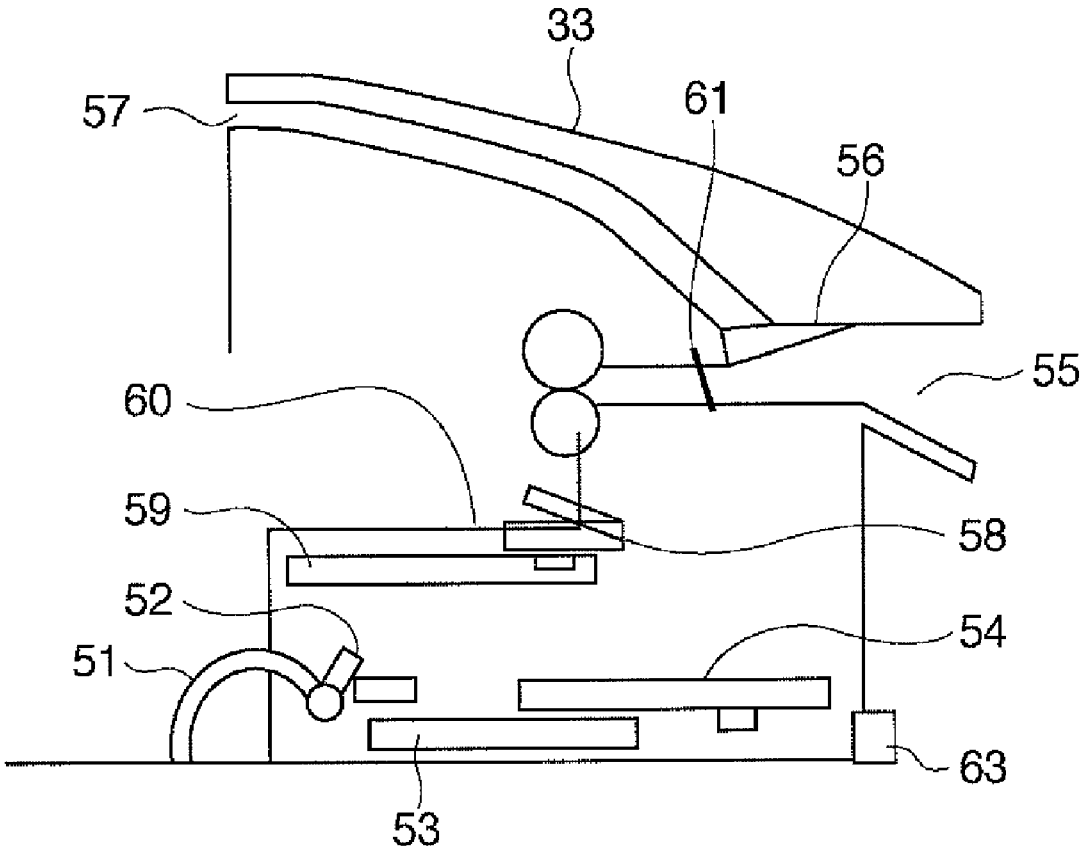
FIG. 2 is a view showing the construction of a post-processing apparatus in FIG. 1.
Figure 3:
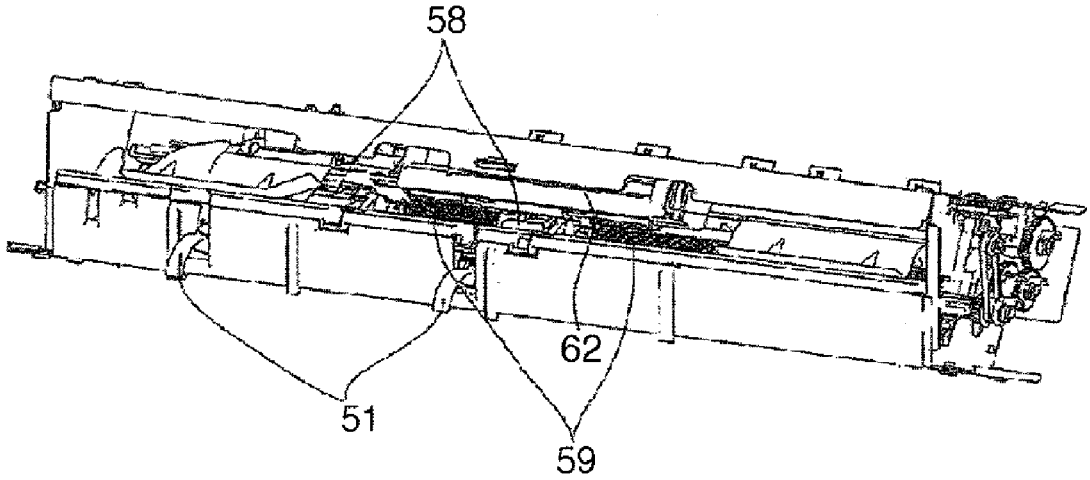
FIG. 3 is a view of the post-processing apparatus as seen from the side of a sheet discharge port thereof.

FIG. 2 shows the construction of the post-processing apparatus 33 in FIG. 1, and FIG. 3 shows the post-processing apparatus 33 as seen from the side of a sheet discharge port thereof.

Figure 4:
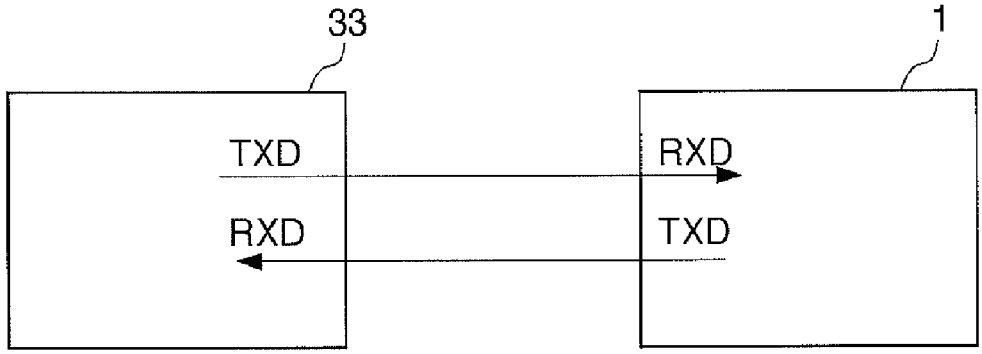
FIG. 4 is a view schematically showing communication between the post-processing apparatus and a printer unit.

The post-processing apparatus 33 for performing post-processing on a recording sheet P being discharged has a sheet entry port 55 formed therein such that the recording sheet P conveyed by the sheet discharge roller 21 enters the interior of the post-processing apparatus 33. The post-processing apparatus 33 has a communication connector 63 having a transmission data terminal TXD and a reception data terminal RXD which are respectively connected to a reception data terminal RXD and a transmission data terminal TXD of a printer unit (shown by reference numeral 1 in FIG. 4). In a process of being fed with a recording sheet from the printer unit 1, the post-processing apparatus 33 carries out communication for synchronization as shown in FIG. 4. The entry of the recording sheet through the sheet entry port 55 is detected by a sensor 61.

Recording sheets P entered in succession through the-sheet entry port 55 are stacked on a bundle tray 60. The recording sheets P stacked on the bundle tray 60 are each moved by a sorting member 62 in a horizontal direction relative to a sheet discharge direction (sorting process).

Figure 5:
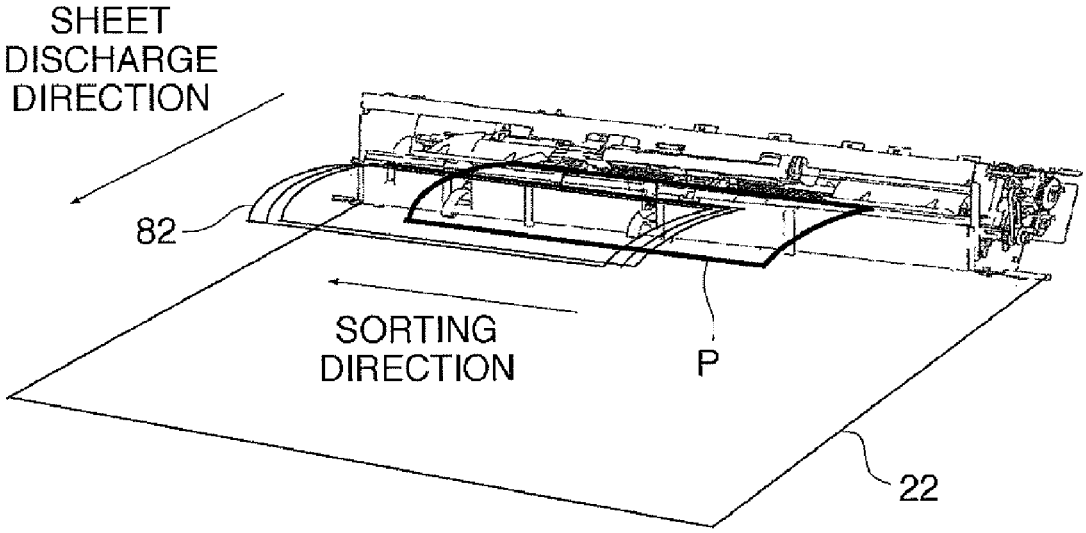
FIG. 5 is a view showing a sorting operation of the post-processing apparatus in FIG. 1.

As shown in FIG. 5, recording sheets P output from the printer unit 1 are each moved in the sorting direction so as to be aligned with one another. After a predetermined number of recording sheets are stacked (a stacked state is shown by reference numeral 82), these recording sheets are stapled, where required, by a stapler (not shown), and then discharged by means of bundle discharge sliders 58.

Bundle-discharge-slider pusher members 59 for driving the bundle discharge sliders 58 are drivingly coupled via coupling members (not shown) to sheet-restraint-pawl driving gears 54, whereby sheet restraint members 51 are driven. The sheet restraint members 51 are operable to restrain discharged recording sheets, thereby suppressing recording sheets after subjected to thermal fixing from being curled.

Paper-full detection flags 52 interconnected with the sheet restraint members 51 are adapted to turn on/off a sheet-full detecting sensor 53 and detect the sheet discharge tray 22 becoming full of sheets based on the thickness of discharged recording sheets P. When a flapper 56 is switchingly operated, a recording sheet P is conveyed to a conveyance path 57 for sheet reverse in double-sided conveyance, described later.

Next, a description will be given of a double-sided image forming operation of the image forming apparatus of this embodiment.

Portions of the double-sided image forming operation up to a full color toner image is thermally fixed onto a recording sheet P by the fixing unit 16 are the same as relevant portions of the single-sided image forming operation. After completion of thermal fixing, the rotation of the sheet discharge roller 21 is stopped in a state in which most part of a recording sheet P is discharged onto the sheet discharge tray 22 by the sheet discharge roller 21.

At that time, the recording sheet P is stopped in a state where the rear end thereof reaches a reverse position. The flapper 56 of the post-processing apparatus 33 is switchingly operated as previously described, and the recording sheet P in the post-processing apparatus 33 is located within the conveyance path 57.

Next, the recording sheet P stopped from being conveyed by stopping the rotation of the sheet discharge roller 21 is fed into a double-sided path having double sided rollers 40, 41 (FIG. 1). To this end, the sheet discharge roller 21 is reversely rotated in a direction opposite to the direction of normal rotation. By the reverse rotation of the sheet discharge roller 21, the recording sheet P located at the reverse position is conveyed so as to reach the double sided roller 40, with the rear end of the recording sheet P directed forward.

Thereafter, the recording sheet P is conveyed by the double sided roller 40 toward the double sided roller 41. Recording sheets P are conveyed in succession by the double sided rollers 40, 41 toward the registration rollers 19. During that time, an image formation start signal is generated.

As in the case of the single-sided image formation, each recording sheet P is moved by the registration rollers 19 toward the secondary transfer part 34 between the secondary transfer opposed roller 10 and the secondary transfer roller 12 in timing in which the tip end of a full color toner image on the intermediate transfer belt 8 is moved toward the secondary transfer part 34.

The toner image is transferred onto the recording sheet P in a state that the tip end of the toner image is made coincident with the tip end of the recording sheet P at the secondary transfer part 34. Subsequently, the image on the recording sheet P is fixed by the fixing unit 16 as in the case of the single-sided image forming operation. Then, the recording sheet P is conveyed again by the sheet discharge roller 21, is caused to enter the post-processing apparatus 33, and is finally discharged onto the sheet discharge tray 22. Whereupon, a series of image forming operations is completed.

Figure 6:
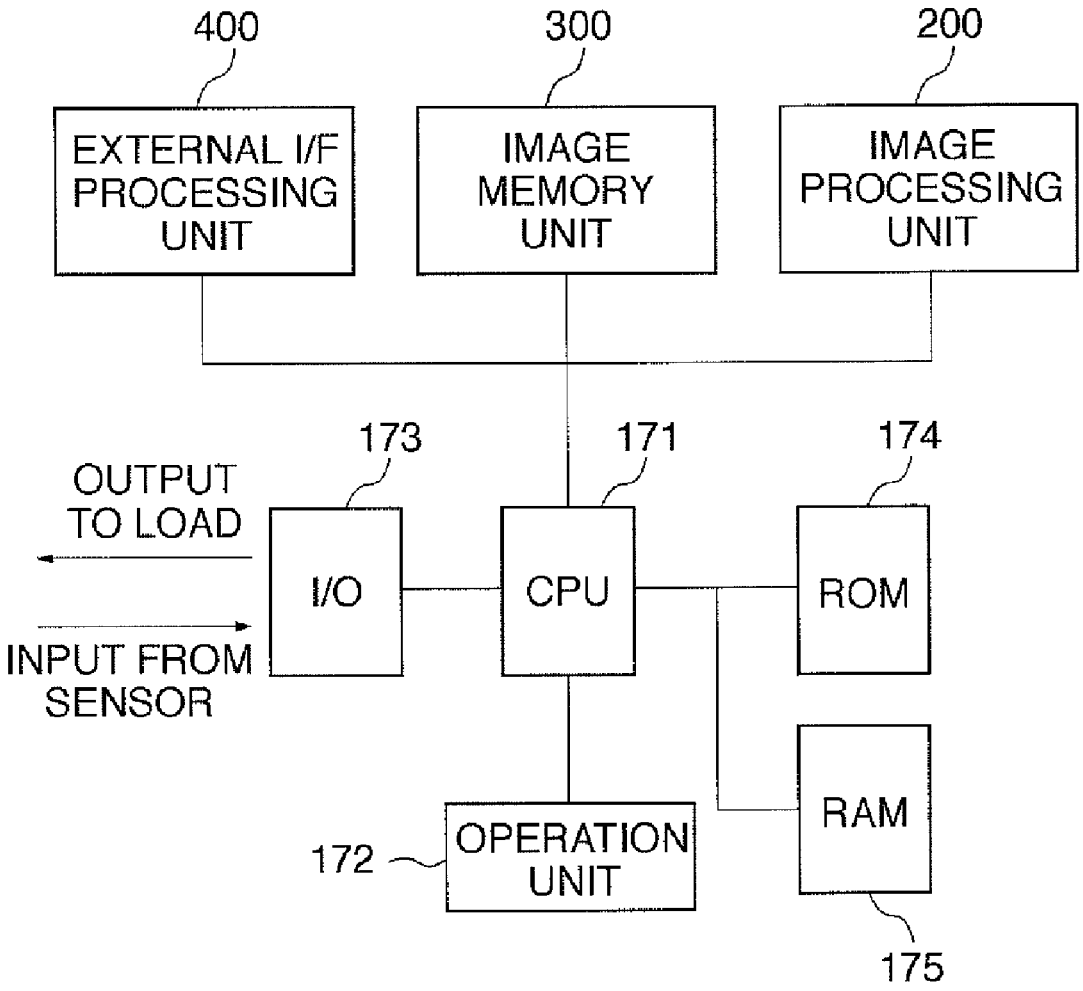
FIG. 6 is a diagram showing control blocks of the image forming apparatus in FIG. 1.

FIG. 6 shows control blocks of the image forming apparatus in FIG. 1.

Referring to FIG. 6, the CPU 171 that implements the basic control of the image forming apparatus is connected via address buses and data buses to a ROM 174 in which a control program is stored, a RAM (work RAM) 175 for temporarily storing calculation results, etc., and an input/output port (I/O) 173.

The CPU 171 functions as a detection unit for detecting a toner use amount at transfer of a partial region of a toner image onto a recording sheet P by the transfer unit. The CPU 171 also functions as a control unit for controlling the interval of conveyance of recording sheets P so as to be increased when it is determined that a toner use amount detected by the detection unit for the partial region of the toner image is equal to or greater than a predetermined amount.

Various loads (not shown) such as motors and clutches for driving the image forming apparatus and a sensor (not shown) for detecting the position of a recording sheet P are connected to the input/output port 173.

The CPU 171 carries out the image forming operations by controlling input and output via the input/output port 173 in accordance with the content stored in the ROM 174. The CPU 171 also controls a display unit and a key input unit of the operation unit 172 connected to the CPU 171.

An operator operates the key input unit to instruct the CPU 171 to switch an image forming operation mode and display. In response to the instruction, the CPU 171 displays the state of the image forming apparatus and the operation mode set by key input.

Connected to the CPU 171 are an external I/F processing unit 400 for transmitting and receiving image data, process data, etc. to and from external equipment such as a PC, an image memory unit 300 for decompressing and temporarily storing an image, and an image processing unit 200 for performing image processing based on line image data transferred from the image memory unit 300.

Next, a description will be given of determination of toner fusion between recording sheets.

Since recording sheets are pressed to each other by the sorting member 62, there is a possibility that toner fusion takes place between the recording sheets.

Figure 7B:
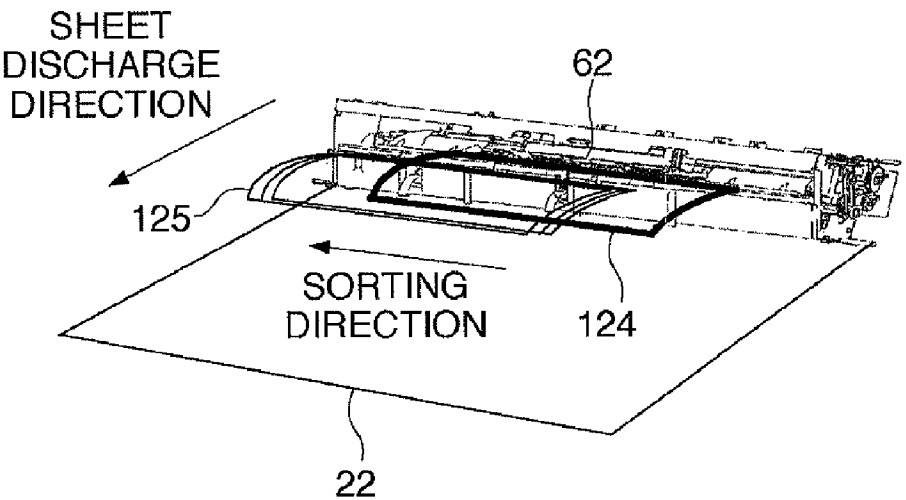
FIG. 7B is a schematic view of the post-processing apparatus as seen from obliquely above, with the sorting member positioned away from the recording sheet.
Figure 7A:
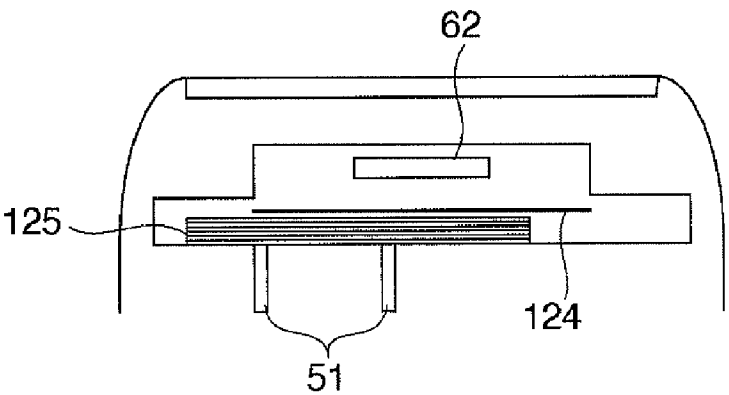
FIG. 7A is a schematic view of the post-processing apparatus as seen from the downstream side in the sheet discharge direction, with a sorting member in FIG. 3 positioned away from a recording sheet.
Figure 8B:
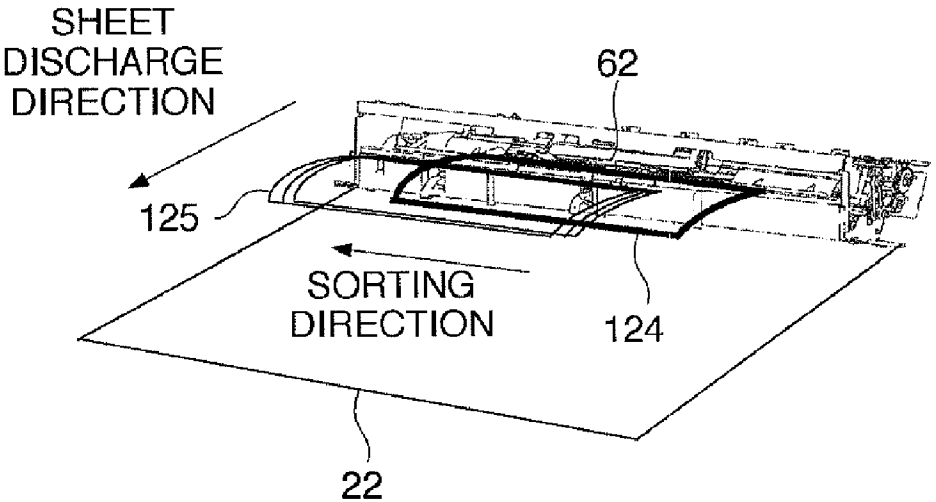
FIG. 8B is a schematic view of the post-processing apparatus as seen from obliquely above, with the sorting member in contact with the recording sheet.
Figure 8A:
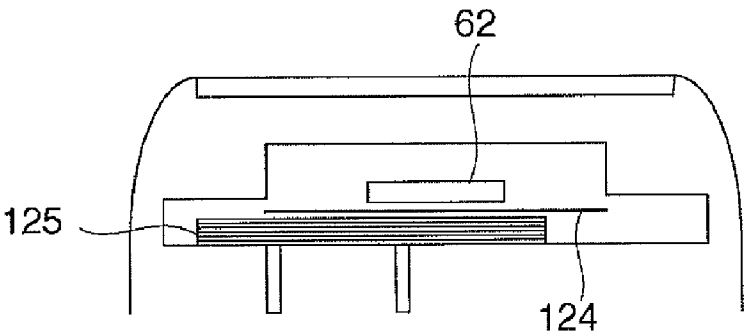
FIG. 8A is a schematic view of the post-processing apparatus as seen from the downstream side in the sheet discharge direction, with the sorting member in contact with the recording sheet.
Figure 9B:
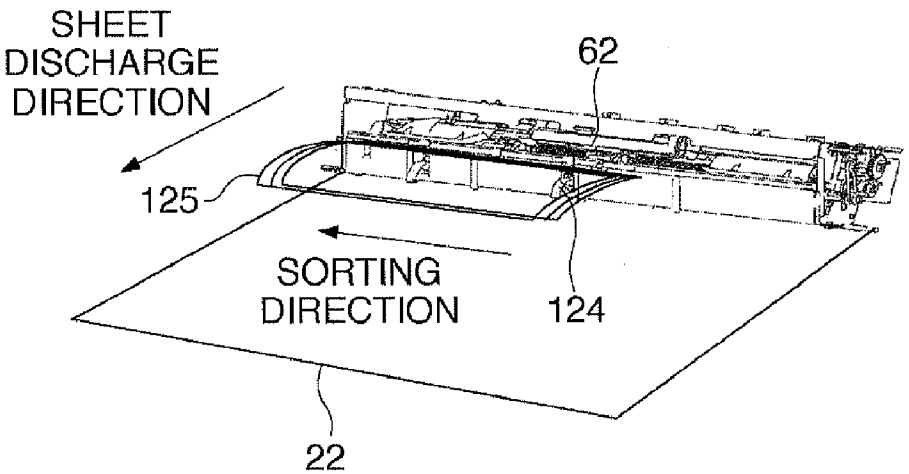
FIG. 9B is a schematic view of the post-processing apparatus as seen from obliquely above, with the sorting member moved in the sorting direction.

FIGS. 7A to 9B schematically show the operation of the sorting member 62 in FIG. 3. FIGS. 7A, 8A and 9A schematically show the post-processing apparatus 33 in FIG. 3 as seen from the side downstream of the sorting member 62 in the sheet discharge direction. FIGS. 7B, 8B and 9B schematically show the post-processing apparatus 33 as seen from obliquely above.

Reference numeral 124 denotes a discharged recording sheet, and reference numeral 125 denotes recording sheets waiting for being stapled. When the recording sheet 124 has been discharged from the printer unit 1 to the post-processing apparatus 33, the sorting member 62 is moved downward from a position shown in FIG. 7A to a position shown in FIG. 8A, such as to be brought in contact with the recording sheet.

Figure 9A:
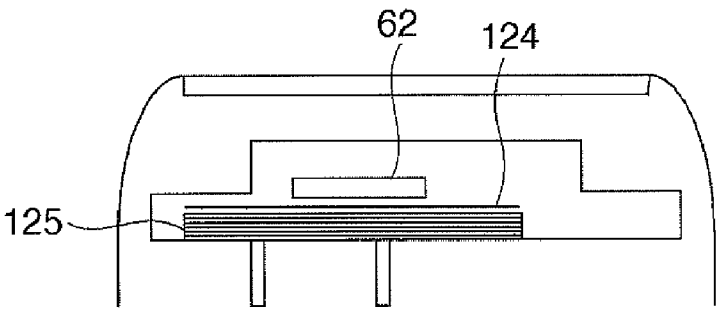
FIG. 9A is a schematic view of the post-processing apparatus as seen from the downstream side in the sheet discharge direction, with the sorting member moved in a sorting direction.

The sorting member 62 made in contact with the recording sheet 124 is moved in the sorting direction, as shown in FIG. 9A, while remaining in contact with the recording sheet 124, whereby the recording sheet 124 is sorted. Recording sheets 124 moved in succession in the sorting direction are stacked on the recording sheets 125 waiting for being stapled, until the number of stacked sheets reaches a staple number of sheets.

When the staple number of sheets is reached, the stacked recording sheets 124 are stapled and then discharged. Toner fusion sometimes occurs when the sorting member 62 is moved downward from FIG. 7A to FIG. 8A and the recording sheet 124 is made in pressure contact with the recording sheets 125 waiting for being stapled.

If, in this state, toner fusion takes place between recording sheets, the discharged recording sheet 124 cannot sufficiently be moved to the sorting position. As a result, alignment failure of recording sheets can occur at the time of sorting, and pages missing can occur at the time of stapling.

That is, the recording sheets 124, 125 in FIG. 8A are affixed together due to toner fusion therebetween, if much tonner is applied to a region of the recording sheet 124 with which the sorting member 62 is made in contact. If the sorting is carried out in a state that the recording sheets are affixed together, alignment failure, pages missing at the time of stapling, or sheet jam is caused.

Next, a description will be given of the detection of toner density.

As previously described with reference to FIG. 1, the laser exposure unit 7 irradiates laser light from the laser emitting unit in accordance with an externally input color-separated image signal, and the laser light is irradiated via the polygon lens, the reflection mirror, etc. onto the photosensitive drums 2*a*-2*d* on which electrostatic latent images in respective colors are thereby formed.

Figure 10:
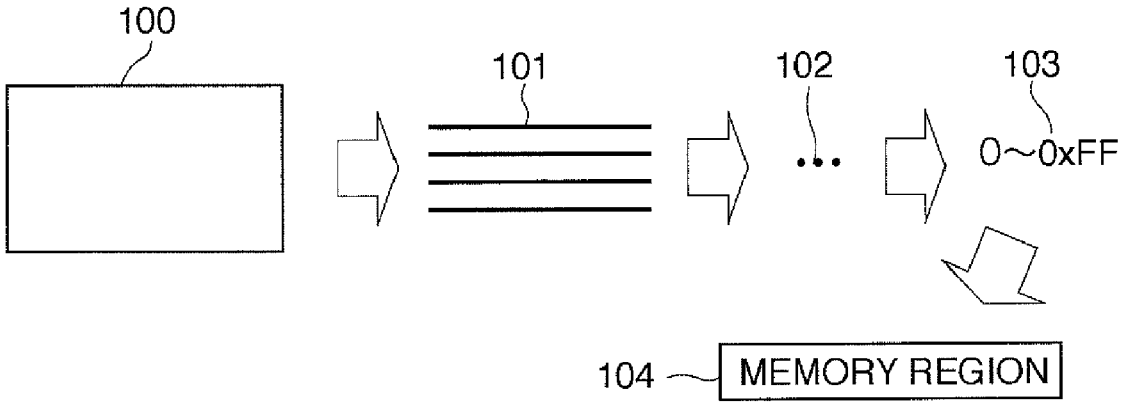
FIG. 10 is a schematic view showing a toner image formed in the image forming apparatus in FIG. 1.

FIG. 10 schematically shows a toner image formed in the image forming apparatus in FIG. 1.

As shown in FIG. 10, a toner image 100 on each page is an aggregate of laser scanned lines 101, wherein each of the lines 101 is an aggregate of dots 102 formed in accordance with the waveform of a laser signal.

In this embodiment, the apparatus has performance of forming 600 dots per inch in default. Electric potential 103 (toner transfer rate) at each dot 102 of the toner image 100 is controlled to a desired one of 16 levels from 0 to 15, whereby the densities in various parts of the electrostatic latent image are determined.

At the time of laser irradiation, a value obtained by integrating electric potentials at respective dots in a one-page image is stored into the memory region 104, whereby toner density information on the one-page image can be obtained.

Figure 12:
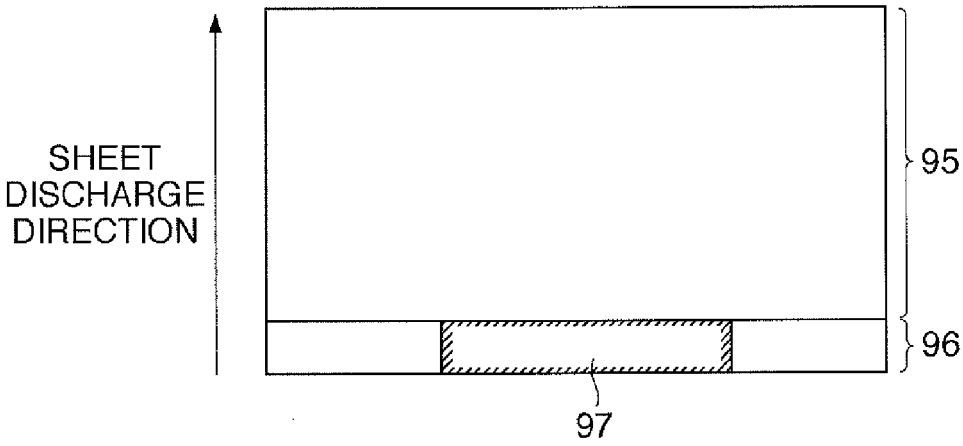
FIG. 12 is a view showing the distribution of toner on a recording sheet used in the image forming apparatus.

Referring to FIG. 12, a toner image 95, 96 transferred to a recording sheet includes a predetermined region 97 with which the sorting member 62 is made in contact. In the predetermined region 97, there is a fear that toner fusion takes place between recording sheets due to the contact by the sorting member 62. To obviate this, in this embodiment, a toner use amount in the region of the rear-end-side toner image 96 of each recording sheet is measured, and the recording sheet conveyance interval is controlled in accordance with a result of the measurement, whereby an occurrence of toner fusion is suppressed. The predetermined toner image region 97 corresponds to a recording sheet region with which the sorting member 62 is made contact.

In the case, for example, of an A3-sized recording sheet (297 mm×420 mm), a toner use amount in a recording sheet region extending up to 50 mm from the rear end of the recording sheet.

Figure 11:
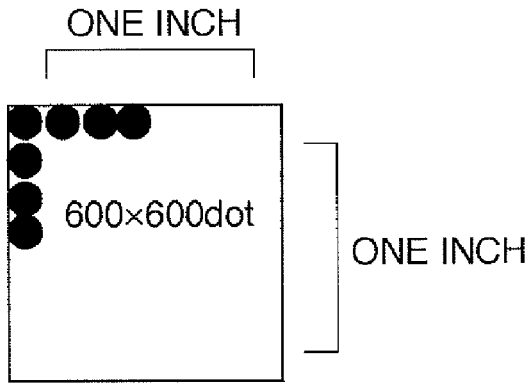
FIG. 11 is a schematic view showing a toner image formed in the image forming apparatus in FIG. 1.

FIG. 11 schematically shows a toner image formed in the image forming apparatus in FIG. 1.

In a case that the printing density representing the printing performance of the image forming apparatus is 600 dots per inch (25.4 mm) as shown in FIG. 11, the number of dots in a one-page image is equal to (297/25.4)×600×(420/25.4)×600. Electric potentials at all the dots in each one-page image are obtained and an integrated value of the electric potentials is calculated. If the integrated value is equal to or greater than a predetermined value, it is determined that a toner use amount used for the one-page image is large and hence there is a high possibility of occurrence of toner fusion between recording sheets due to the pressure contact by the sorting member 62.

Figure 13:
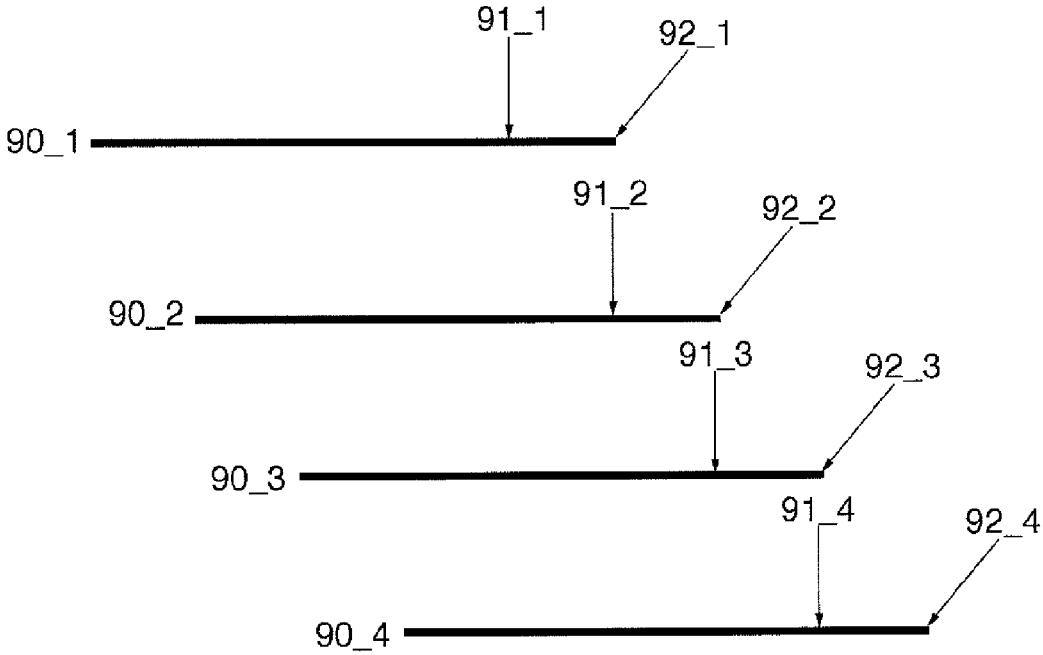
FIG. 13 is a view showing preparation times for toner images in respective colors in the image forming apparatus.

FIG. 13 shows time periods for formation of YMCK color toner images (formation start and end timings).

From the memory region 104 in FIG. 10, a toner use amount from color-toner-image-formation start time points 90_1 to 90_4 to time points 91_1 to 91_4 is acquired. The time points 91_1 to 91_4 each correspond to a position 50 mm short of the rear end of the recording sheet. Also, a toner use amount from the image-formation start time points 90_1 to 90_4 to image-formation end time points 92_1 to 92_4 is acquired. By determining the difference between these toner use amounts, it is possible to obtain a toner use amount used for the rear-end-side toner image region, which corresponds to a rear-end-side recording sheet region extending from the rear end of the recording sheet up to a position 50 mm short of the recording sheet rear end.

It the toner use amount in the rear-end-side toner image region is equal to or larger than a predetermined value, it is determined that the amount of toner applied to the recording sheet is large and there is a high possibility of occurrence of toner fusion between recording sheets due to contact by the sorting member 62.

Figure 14:
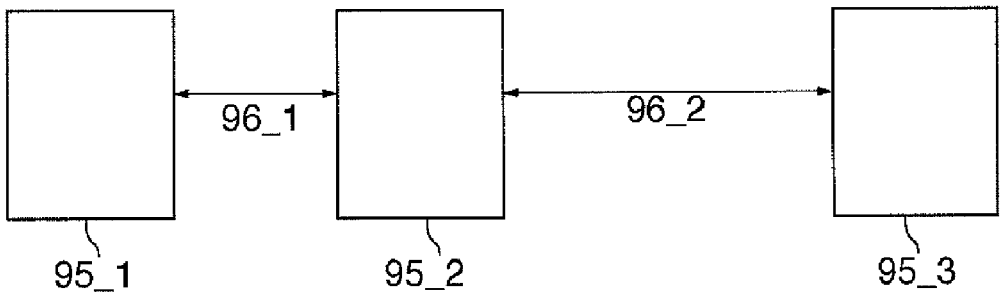
FIG. 14 is a view showing recording sheet conveyance intervals in the image forming apparatus.

FIG. 14 shows intervals of conveyance of recording sheets 95_1 to 95_3.

During the conveyance at a first normal conveyance interval 96_1, if the integrated data of electrical potentials at respective dots in the rear-end-side image region is equal to or larger than a predetermined value, the amount of toner applied to the rear-end-side image region is large and there is a high possibility that toner fusion takes place between recording sheets due to contact by the sorting member 62. Thus, the CPU 171 as the control unit sets the second conveyance interval 96_2 wider than the first conveyance interval 96_1, as the recording sheet conveyance interval.

If the toner use amount in the predetermined toner image region 97 is equal to or larger than the predetermined amount, the CPU 171 determines that toner fusion can take place between recording sheets when conveyed at the first conveyance interval 96_1, and changes the sheet conveyance interval to the second conveyance interval 96_2, thereby preventing toner fusion from occurring.

Usually, immediately after a recording sheet P entering the sheet entry port 55 of the post-processing apparatus 33 in FIG. 2 is loaded at a rear end portion thereof on the bundle tray 60, the sorting member 62 is brought in contact with the recording sheet P and the recording sheet P is moved in the sorting direction by means of the sorting member 62. On the other hand, if it is determined that there is a high possibility of occurrence of toner fusion, a signal is transmitted from the printer unit 1 to the post-processing apparatus 33 as shown in FIG. 4, whereby the sorting member 62 is delayed to be brought in contact with the recording sheet P.

With the above operation, toner fusion between a recording sheet P to which much amount of toner is applied and recording sheets P stacked on the bundle tray 60 can be prevented. A waiting time required for the recording sheet P to be cooled is about 4 seconds in this embodiment.

Figure 15:
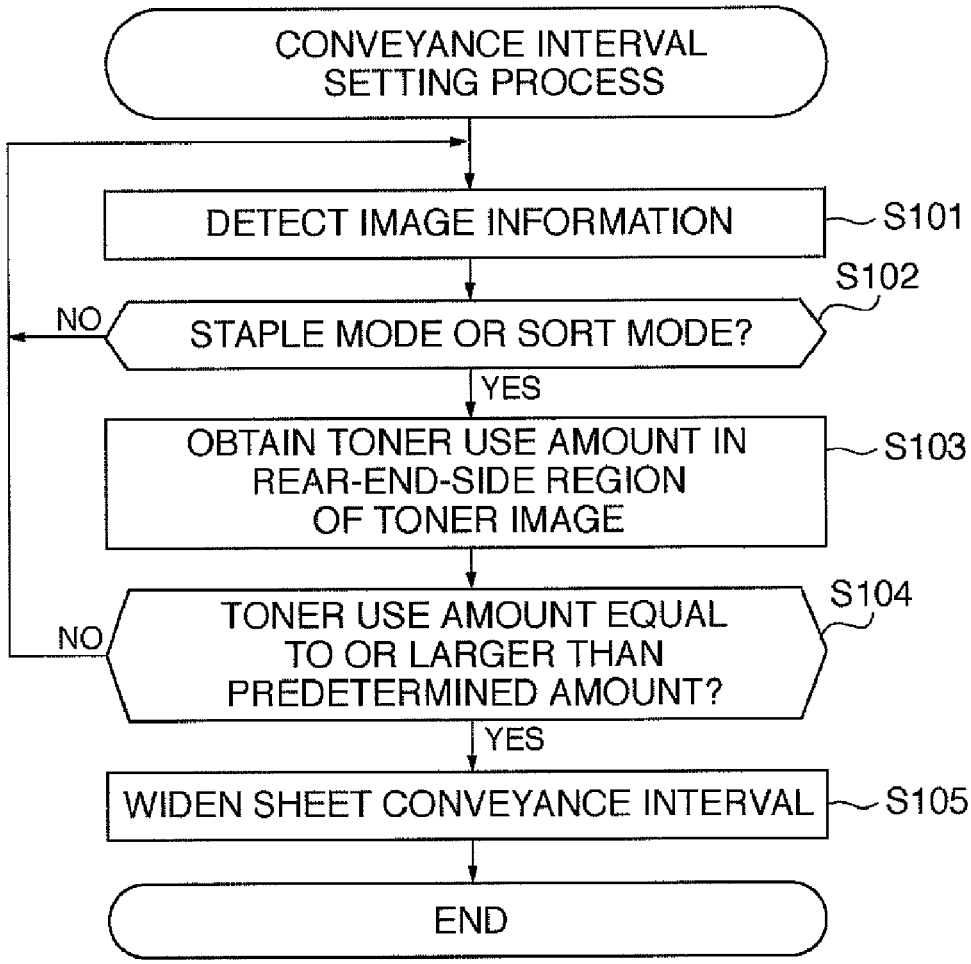
FIG. 15 is a flowchart showing the procedures of a recording sheet conveyance interval setting process implemented by the image forming apparatus.

FIG. 15 shows in flowchart the procedures of a recording sheet conveyance interval setting process implemented by the image forming apparatus in FIG. 6. This setting process is implemented by the CPU 171 in FIG. 6.

As shown in FIG. 15, when a job (image information) is detected (step S101), the CPU 171 determines whether or not the current operation mode is a post-processing mode in which there is a possibility that toner fusion takes place at the time of sheet discharge. Specifically, the CPU 171 determines whether or not the current operation mode is a staple mode or a sort mode (step S102).

If the current operation mode is either the staple mode or the sort mode, the CPU 171 obtains the toner use amount in the predetermined toner image region 97 shown in FIG. 12 (step S103). The CPU 171 determines whether or not the obtained toner use amount in the predetermined region 97 is equal to or larger than the predetermined amount (step S104). If it is determined that the toner use amount is equal to or larger than the predetermined amount, the CPU 171 sets the conveyance interval such that the recording sheet conveyance interval is widened to avoid occurrence of toner fusion (step S105). Whereupon, the present setting process is completed.

On the other hand, if the current mode is not the staple mode nor the sort mode, there is a low possibility of occurrence of toner fusion. In that case, the image forming process is carried out in the current operation mode until completion of the job based on image formation on each page. Also in a case where the toner use amount in the predetermined toner image region 97 is less than the predetermined amount, the image forming process is carried out as usual based on image information on each page until completion of the job.

As described above, according to this embodiment, it is unnecessary to provide a cooling fan for preventing toner fusion between recording sheets, whereby increase in cost and size of the apparatus can be avoided. The toner use amount in the entire image is not referred to, but the toner use amount in the predetermined toner image region 97 (corresponding to the recording sheet rear end region with which the sorting member 62 is made in contact) is referred to. Therefore, toner fusion between recording sheets can be prevented with a construction which does not unduly lower the productivity.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2007-197495, filed Jul. 30, 2007, which is hereby incorporated by reference herein in its entirety.

What is claimed is:

1. An image forming apparatus comprising:

a transfer unit adapted to transfer a toner image onto a recording sheet;

a detection unit adapted to detect a toner use amount at transfer of a partial region of the toner image onto the recording sheet by said transfer unit;

a control unit adapted to control a recording sheet conveyance interval in accordance with the toner use amount detected by said detection unit for the partial region of the toner image; and a pressing member for pressing a recording sheet to which a toner image has been transferred, wherein said pressing member is disposed for a slide motion toward and away from the recording sheet to which the toner image has been transferred, and makes the slide motion while remaining in contact with the recording sheet to which the toner image has been transferred, thereby causing a slide motion of the recording sheet.

2. The image forming apparatus according to claim 1, wherein the partial region of the toner image corresponds to a region of the recording sheet with which said pressing member is brought in contact.

3. The image forming apparatus according to claim 1, wherein:

the recording sheet conveyance interval includes at least a first conveyance interval and a second conveyance interval wider than the first conveyance interval, and in a case where recording sheets are conveyed at the first conveyance interval, if the toner use amount in the partial region of the toner image is determined to be equal to or greater than a predetermined amount, said control unit changes the recording sheet conveyance interval from the first conveyance interval to the second conveyance interval.

* * * * *